US009223273B1

(12) United States Patent
Fuse

(10) Patent No.: US 9,223,273 B1
(45) Date of Patent: Dec. 29, 2015

(54) IMAGE FORMING APPARATUS AND CONTROL METHOD THEREOF

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroyuki Fuse, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/448,127

(22) Filed: Jul. 31, 2014

(51) Int. Cl.
*G03G 15/01* (2006.01)
*G03G 15/00* (2006.01)

(52) U.S. Cl.
CPC ..... *G03G 15/50* (2013.01); *G03G 15/5033* (2013.01); *G03G 15/5041* (2013.01)

(58) Field of Classification Search
CPC ..... G03G 15/50; G03G 2215/0161; G03G 15/5033; G03G 15/5041
USPC ..... 399/15, 49, 72, 301
See application file for complete search history.

(56) References Cited

U.S. PATENT DOCUMENTS 8,717,639 B2 * 5/2014 Arakawa ..... 358/488
8,862,000 B2 * 10/2014 Murayama et al. ..... 399/49

* cited by examiner

*Primary Examiner* — Hoang Ngo
(74) *Attorney, Agent, or Firm* — Amin, Turocy & Watson, LLP

(57) ABSTRACT

A first control section controls the several image forming sections to form first patterns including a first straight line and a second straight line inclined to a first angle against the first straight line. A first adjustment section adjusts an operating condition of the one or more sub-forming sections to minimize the deviation of the image formation positions of the one or more sub-forming sections with respect to the image formation position by the main forming section. A second control section controls the several image forming sections to form second patterns including a third straight line and a fourth straight line inclined to a second angle larger than the first angle against the third straight line. A second adjustment section adjusts an operating condition of the one or more sub-forming sections to minimize the difference in the magnification between the main forming and the one or more sub-forming sections.

7 Claims, 6 Drawing Sheets

IMAGE FORMING APPARATUS AND CONTROL METHOD THEREOF

FIELD

Embodiments described herein relate generally to an image forming apparatus and a control method thereof.

BACKGROUND

There is known a tandem type image forming apparatus which comprises a plurality of image forming sections for forming a color image.

In this type of image forming apparatus, it is important to improve the image quality to reduce the deviation of the images (hereinafter referred to as element image) formed by each of the plurality of image forming sections as much as possible. Thus, the parameters relating to the operations of each of the plurality of image forming sections are properly adjusted.

One of the parameters mentioned above is horizontal scanning magnification. The change of the horizontal scanning magnification has an impact as the change in the size of the element image in the horizontal scanning direction.

Thus, a test image having a given pattern nearby two ends of an image forming range in the horizontal scanning direction is formed by each of a plurality of image forming sections, and the deviation of the horizontal scanning magnification is measured according to the deviation of the position relation between two patterns in the test images. In order to detect the deviation of the position relation between two patterns in the test images, it is necessary to arrange two sensors nearby each of two ends of the image forming range in the horizontal scanning direction.

Thus, it is preferred to reduce the number of the sensors for adjusting the horizontal scanning direction magnification to one.

DETAILED DESCRIPTION

Figure 1:
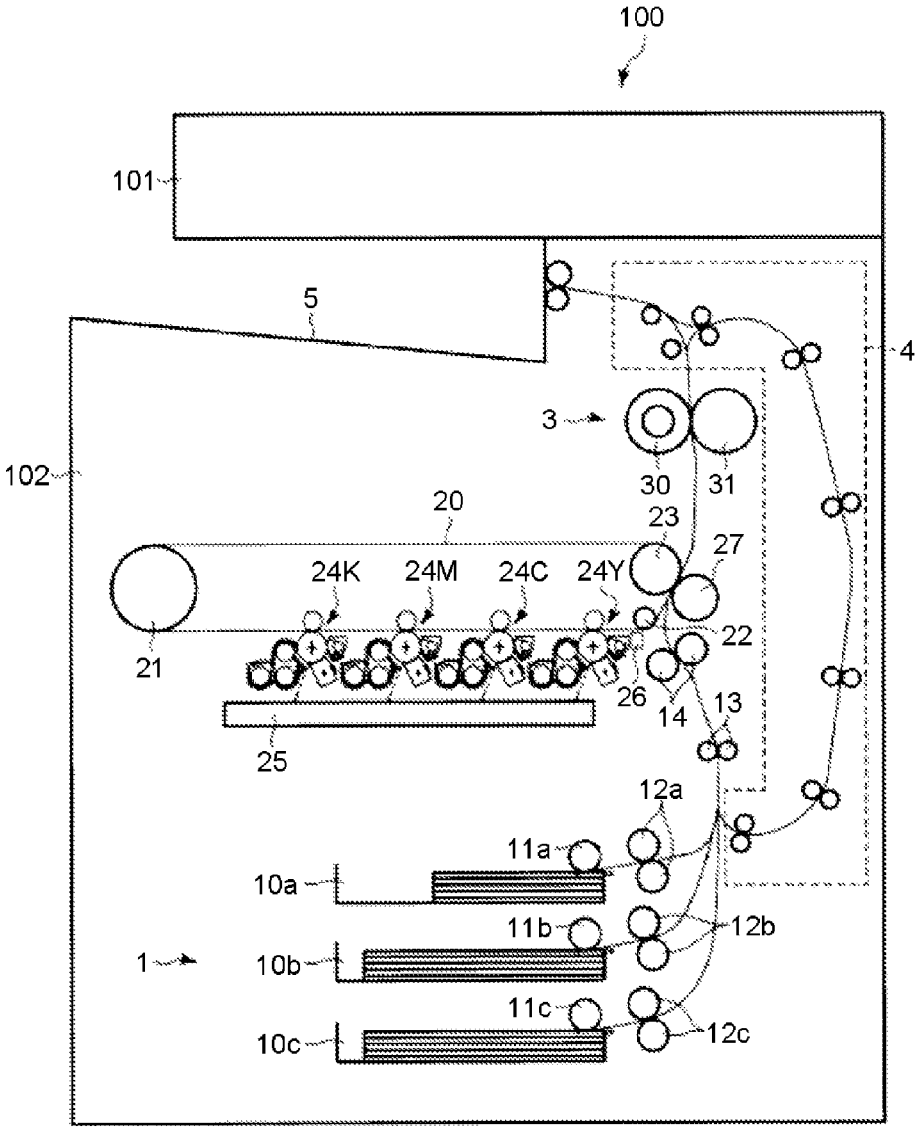
FIG. 1 is a diagram schematically illustrating the constitutions of a MFP according to one embodiment.

In accordance with one embodiment, an image forming apparatus comprises a plurality of image forming sections, a detection section, a first control section, a first adjustment section, a second control section and a second adjustment section. The plurality of image forming sections, which are arranged in parallel in a vertical scanning direction intersecting a horizontal scanning direction in such a manner that the horizontal scanning directions thereof are parallel to each other, configured to form images with coloring agent at formation positions thereof on a medium moving in the vertical scanning direction; wherein the plurality of image forming sections can further change the magnifications of the formed images in the horizontal scanning direction, separately, and one of the plurality of image forming sections is pre-determined as a main forming section and one or a plurality of the other image forming sections is pre-determined as a sub-forming section. The detection section configured to detect the existence of the coloring agent at one detection position in the horizontal scanning direction for a medium which passed through the formation position of each of the plurality of image forming sections. The first control section configured to control the plurality of image forming sections to form first patterns including a first straight line in the horizontal scanning direction that crosses the detection position and a second straight line that crosses the detection position and is inclined to a first angle against the first straight line on different areas of the medium, respectively. The first adjustment section configured to adjust an operating condition of the one or the plurality of sub-forming sections to minimize the deviation of the image formation positions of the one or the plurality of sub-forming sections with respect to the image formation position of the main forming section based on the detection timing of the detection section during a period when the plurality of first patterns formed by the plurality of image forming sections under the control of the first control section pass through the detection section. The second control section configured to control the plurality of image forming sections to form second patterns including a third straight line in the horizontal scanning direction that crosses the detection position and a fourth straight line that crosses the detection position and is inclined to a second angle larger than the first angle against the third straight line on different areas of the medium, respectively. The second adjustment section configured to adjust an operating condition of the one or the plurality of sub-forming sections to minimize the difference in the magnification between the main forming section and the one or the plurality of sub-forming sections based on the detection timing of the detection section during a period when the plurality of second patterns formed by the plurality of image forming sections under the control of the second control section pass through the detection section.

Hereinafter, an example of the embodiment is described with reference to the accompanying drawings. In addition, in the present embodiment, a MFP (multi-function peripheral) including an image forming apparatus as a printer is described as an example.

FIG. 1 is a diagram schematically illustrating the constitutions of a MFP 100 according to the present embodiment.

As shown in FIG. 1, the MFP 100 comprises a scanner 101 and a printer 102.

The scanner 101 reads an image of a document to generate image data corresponding to the read image. The scanner 101 generates image data corresponding to the reflected light image from the reading surface of the document using an image sensor such as a CCD line sensor and the like. The scanner 101 may scan the document placed on a document table with an image sensor moving along the document, or scan the document conveyed by an ADF (auto document feeder) with a fixed image sensor.

The printer 102 forms an image through an electrophotographic system on paper serving as an image-formed medium. The printer 102 has a color printing function of printing a color image on paper and a monochrome printing function of printing a monochrome image on paper. The printer 102 overlaps and forms element images using toner of three colors (for example, yellow, cyan and magenta) or toner of four colors (for example, yellow, cyan, magenta and black) respectively to form a color image. Further, the printer 102 forms a monochrome image using, for example, black toner. The printer 102 is not limited to the electrophotographic type as long as the horizontal scanning magnification can be changed. For example, the printer 102 may be an inkjet type or a thermal transfer type printer.

In the constitution example shown in FIG. 1, the printer 102 comprises a paper feed section 1, a printer engine 2, a fixing section 3, an ADU (automatic double-sided unit) 4 and a paper discharge tray 5.

The paper feed section 1 includes paper feed cassettes 10*a*, 10*b* and 10*c*; pickup rollers 11*a*, 11*b* and 11*c*; conveyance rollers 12*a*, 12*b* and 12*c*; a conveyance roller 13 and a register roller 14.

The paper feed cassettes 10*a*, 10*b* and 10*c* respectively store paper of set categories (for example, size and material) in a stacked state. In addition, though it is expressed as "paper", the material is not limited to paper, and it may also be resin and the like. The paper feed section 1 further includes a manual feeding tray.

The pickup rollers 11*a*, 11*b* and 11*c* picks up paper one by one from each of the paper feed cassettes 10*a*, 10*b* and 10*c*. The pickup rollers 11*a*, 11*b* and 11*c* convey the picked up paper to the conveyance rollers 12*a*, 12*b* and 12*c*.

The conveyance rollers 12*a*, 12*b* and 12*c* convey the paper conveyed from the pickup rollers 11*a*, 11*b* and 11*c* to the conveyance roller 13 through conveyance paths consisting of guide members (not shown) and the like.

The conveyance roller 13 further conveys the paper conveyed from any of the conveyance rollers 12*a*, 12*b* and 12*c* to the register roller 14.

The register roller 14 corrects the inclination of the paper and adjusts the timing for conveying the paper to the printer engine 2.

In addition, the numbers of the paper feed cassettes, the pickup rollers and the conveyance rollers may be less or more than three but not limited to three. Further, it is also applicable not to arrange the paper feed cassette, and the pickup roller and the conveyance roller in pair with the paper feed cassette as long as the manual feeding tray is arranged.

The printer engine 2 includes an endless transfer belt 20; supporting rollers 21, 22 and 23; image forming sections 24K, 24M, 24C and 24Y; an exposure section 25; a sensor 26 and a transfer roller 27.

The endless transfer belt 20 is supported by the supporting rollers 21, 22 and 23 to maintain a state shown in FIG. 1. The transfer belt 20 rotates anticlockwise in FIG. 1 along the rotation of the supporting roller 21. The transfer belt 20 temporarily carries the image to be formed on the paper.

Each of the image forming sections 24K, 24M, 24C and 24Y includes a photoconductive drum, a charging device, a developing device, a transfer roller and a cleaner, and has a well-known structure for carrying out image forming processing based on the electrophotographic system through the cooperation with the exposure section 25. The image forming sections 24K, 24M, 24C and 24Y are arranged along the transfer belt 20 in a state in which the directions of the shafts of each photoconductive drum are parallel to each other. The image forming section 24K forms an element image with black toner. The image forming section 24M forms an element image with magenta toner. The image forming section 24C forms an element image with cyan toner. The image forming section 24Y forms an element image with yellow toner. The image forming sections 24K, 24M, 24C and 24Y overlap the element images of each color on the transfer belt 20. In this way, the image forming sections 24K, 24M, 24C and 24Y overlap the black element image, the magenta element image, the cyan element image and the yellow element image to form a color image on the belt when passing through the image forming section 24Y. In addition, a monochrome image can be formed by only operating the image forming section 24K.

The exposure section 25 includes four laser scanners corresponding to each of the image forming sections 24K, 24M, 24C and 24Y inside. The exposure section 25 exposes each photoconductive drum of the image forming sections 24K, 24M, 24C and 24Y with laser light according to the image data representing the element image of each color. The scanning direction of the laser scanner is consistent with the shaft direction of the photoconductive drum. Thus, the depth direction in FIG. 1 is the horizontal scanning direction and the left-right direction in FIG. 1 is the vertical scanning direction.

The sensor 26 is arranged at a position facing the part of the transfer belt 20 between the image forming section 24Y and the transfer roller 27. The sensor 26 detects the existence of toner on the transfer belt 20 at a detection position determined as one point in the horizontal scanning direction. The sensor 26 outputs a binary detection signal corresponding to the existence of toner.

The transfer roller 27 is arranged parallel to the supporting roller 23 to nip the transfer belt 20 with the supporting roller 23. The transfer roller 27 nips, through the cooperation with the transfer belt 20, the paper conveyed from the register roller 14. Then the transfer roller 27 electrostatically transfers the image formed on the transfer belt 20 to the paper.

In this way, the printer engine 2 forms an image through the electrophotographic system on the paper conveyed by the register roller 14.

The fixing section 3 includes a fixing roller 30 and a pressing roller 31.

The fixing roller 30 is provided with a heater inside a hollow roller including, for example, heat-resistant resin. Though the heater is described as, for example, an IH (induction heating) heater, other type of heaters may also be used properly. The fixing roller 30 melts the toner adhered to the paper conveyed from the printer engine 2 to fix the toner on the paper.

The pressing roller 31 is arranged parallel to the fixing roller 30 and in a state of being pressed against the fixing roller 30. The pressing roller 31 nips, through the cooperation with the fixing roller 30, the paper conveyed from the printer engine 2 and presses the paper towards the fixing roller 30.

The ADU 4 consisting of a plurality of rollers carries out the following two operations selectively. The first operation is conveying the paper passing through the fixing section 3 to the paper discharge tray 5 directly. The first operation is carried out in a case where simplex printing is carried out or in a case where duplex printing is ended. The second operation is conveying the paper passing through the fixing section 3 towards the paper discharge tray 5 temporarily and then switching back the paper and conveying the paper towards the printer engine 2. The second operation is carried out in a case where only one side of the paper is subjected to image forming processing in duplex printing.

The paper discharge tray 5 receives the discharged paper on which an image is formed.

Next, the constitutions of the control system of the MFP 100 are described.

Figure 2:
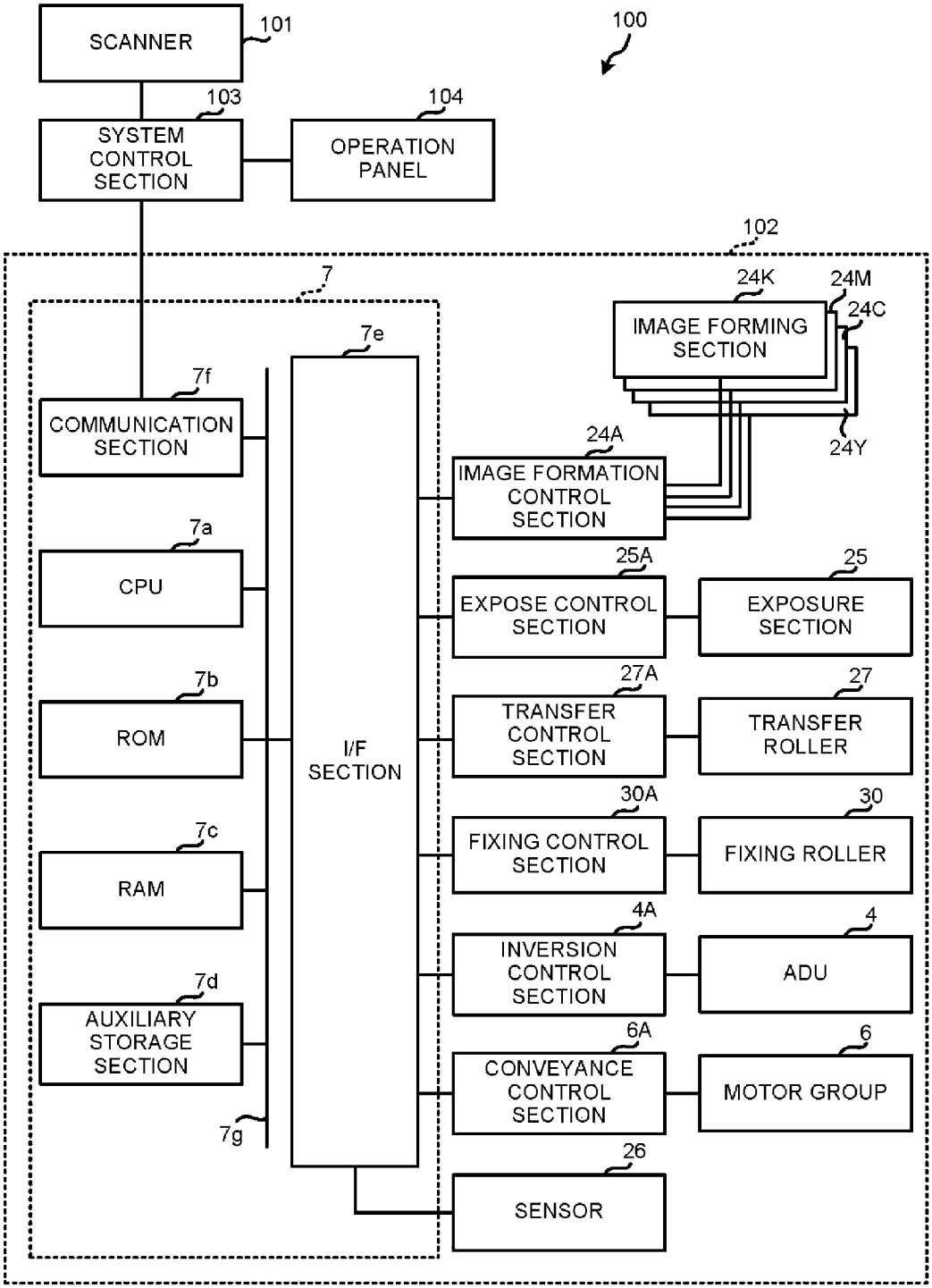
FIG. 2 is a block diagram schematically illustrating the constitutions of a control system of the MFP shown in FIG. 1.

FIG. 2 is a block diagram schematically illustrating the constitutions of the control system of the MFP 100. In addition, components in FIG. 2 which are the same as those shown in FIG. 1 are applied with the same reference numerals, and the detailed descriptions thereof are not repeated.

The MFP 100 further includes a system control section 103 and an operation panel 104 in addition to the scanner 101 and the printer 102.

The system control section 103 uniformly controls each section constituting the MFP 100 to realize the expected operations of the MFP 100. In addition, the expected operations of the MFP 100 are, for example, the operations for realizing various functions realized by the existing MFP.

The operation panel 104 includes an input device and a display device. The operation panel 104 inputs an instruction of an operator through the input device. The operation panel 104 displays, through the display device, various kinds of information to be notified to the operator. For example, a touch panel may be used as the operation panel 104.

In addition to each section described above, the printer 102 further includes a motor group 6, a printer control section 7, an inversion control section 4A, a conveyance control section 6A, an image formation control section 24A, an expose control section 25A, a transfer control section 27A and a fixing control section 30A.

The motor group 6 includes a plurality of motors for rotating the pickup rollers 11*a*, 11*b* and 11*c*, the conveyance rollers 12*a*, 12*b* and 12*c*, the conveyance roller 13, the register roller 14, the supporting roller 21, the transfer roller 27, the fixing roller 30, the photoconductive drums and the various rollers contained in the image forming sections 24K, 24M, 24C and 24Y, and the roller contained in the ADU 4 and the like.

All of the inversion control section 4A, the conveyance control section 6A, the image formation control section 24A, the expose control section 25A, the transfer control section 27A and the fixing control section 30A operate under the control of the printer control section 7 to control the operations of the ADU 4, the motor group 6, the image forming sections 24K, 24M, 24C and 24Y, the exposure section 25, the transfer roller 27 and the fixing roller 30, respectively.

The printer control section 7 uniformly controls each section constituting the printer 102 under the control of the system control section 103 to realize the expected operations of the printer 102. The printer control section 7 includes a CPU (central processing unit) 7*a*, a ROM (read-only memory) 7*b*, a RAM (random-access memory) 7*c*, an auxiliary storage section 7*d*, an interface section (I/F section) 7*e*, a communication section 7*f* and a system bus line 7*g*.

The CPU 7*a*, the ROM 7*b*, the RAM 7*c* and the auxiliary storage section 7*d* are connected through the system bus line 7*g* to constitute a computer.

The CPU 7*a* is a central part of the computer mentioned above. The CPU 7*a* controls each section through the interface section 7*e* based on an operating system stored in the ROM 7*b* and an application program stored in the ROM 7*b* or the auxiliary storage section 7*d*.

The ROM 7*b* is a main storage part of the computer. The ROM 7*b* stores the operating system and the application program mentioned above. As occasion demands, the ROM 7*b* also stores data referred to when the CPU 7*a* carries out various processing.

The RAM 7*c* is also a main storage part of the computer mentioned above. The RAM 7*c* stores data referred to when the CPU 7*a* carries out various processing. Further, the RAM 7*c* is also used as a so-called work area for storing data temporarily used when the CPU 7*a* carries out various processing.

The auxiliary storage section 7*d* is an auxiliary storage part of the computer. The auxiliary storage section 7*d* stores the application program, data used when the CPU 7*a* carries out various processing and data generated in the processing carried out by the CPU 7*a*. For example, a HDD (hard disk drive), a SSD (solid state drive) or an EEPROM (electric erasable programmable read-only memory) and the like can be used as the auxiliary storage section 7*d*.

The interface section 7*e* is connected with the system bus line 7*g* and the inversion control section 4A, the conveyance control section 6A, the image formation control section 24A, the expose control section 25A, the transfer control section 27A, the fixing control section 30A and the sensor 26, respectively. The interface section 7*e* mediates the transfer of information and signal between the CPU 7*a* and the inversion control section 4A, the conveyance control section 6A, the image formation control section 24A, the expose control section 25A, the transfer control section 27A and the fixing control section 30A. Further, the interface section 7*e* transmits the detection signal output by the sensor 26 to the CPU 7*a*.

The communication section 7*f* communicates with the system control section 103 under the control of the CPU 7*a*, which makes the transfer of information between the CPU 7*a* and the system control section 103 possible.

For example, an existing device such as a general one-chip computer and the like can be used as the hardware of the printer control section 7. The printer control section 7 can be realized by installing a control program serving as an application program described in a later-described control processing in the auxiliary storage section 7*d* of such a type of device by the seller or the operator of the MFP 100. At this time, the control program is distributed to the seller or the operator through a network or by being recorded in a removable recording medium such as a magnetic disc, a magnetic optical disk, an optical disk, a semiconductor memory and the like. In addition, the control program may also be stored in the ROM 7*b* in advance.

Next, the operations of the MFP 100 having the constitution described above are described. In addition, in the operations of the MFP 100, only the operations relating to the adjustment work (hereinafter referred to as adjustment work) for reducing the deviation of the element images formed by each of the image forming sections 24K, 24M, 24C and 24Y are different from the operations of other existing MFP, therefore, the following description is mainly about the operations relating to the adjustment work. Thus, the MFP 100 can carry out various operations that are realized by other existing MFP and are not described herein.

As stated above, the MFP 100 overlaps the black, magenta, cyan and yellow element images respectively formed by the image forming sections 24K, 24M, 24C and 24Y to form one color image. Thus, if deviation occurs in the four element images, the quality of the image is reduced.

Thus, the adjustment work is carried out before the shipment of the MFP 100, during the arrangement work of the MFP 100, during the periodic maintenance in application, or during the emergency maintenance carried out when image quality degradation occurs. As parameters to be adjusted in the adjustment work, there is a first starting position, a second starting position, a first magnification and a second magnification.

The first and the second starting positions are positions of the pixel (hereinafter referred to as reference pixel) initially formed in one element image. It does not matter whether the reference pixel is colored or not colored. The first starting position represents the position of the reference pixel in the horizontal scanning direction. The second starting position represents the position of the reference pixel in the vertical scanning direction. The first and the second starting positions are also referred to as a horizontal scanning writing position and a vertical scanning writing position.

The first and the second magnifications are the difference of sizes of the element images formed based on the same image data in the horizontal scanning direction and the vertical scanning direction. The first and the second magnifications are also referred to as a horizontal scanning magnification and a vertical scanning magnification.

The operator carrying out the adjustment work carries out a given operation for requesting the implementation of the adjustment work on the operation panel 104. The system control section 103 receives the operation and instructs the CPU 7*a* to start the adjustment processing. The CPU 7*a*, if receiving the instruction, starts the control processing according to the control program stored in the ROM 7*b* or the auxiliary storage section 7*d*. In addition, the content of the control processing described below is just an example, and the same result can be achieved by carrying out various processing properly.

Figure 3:
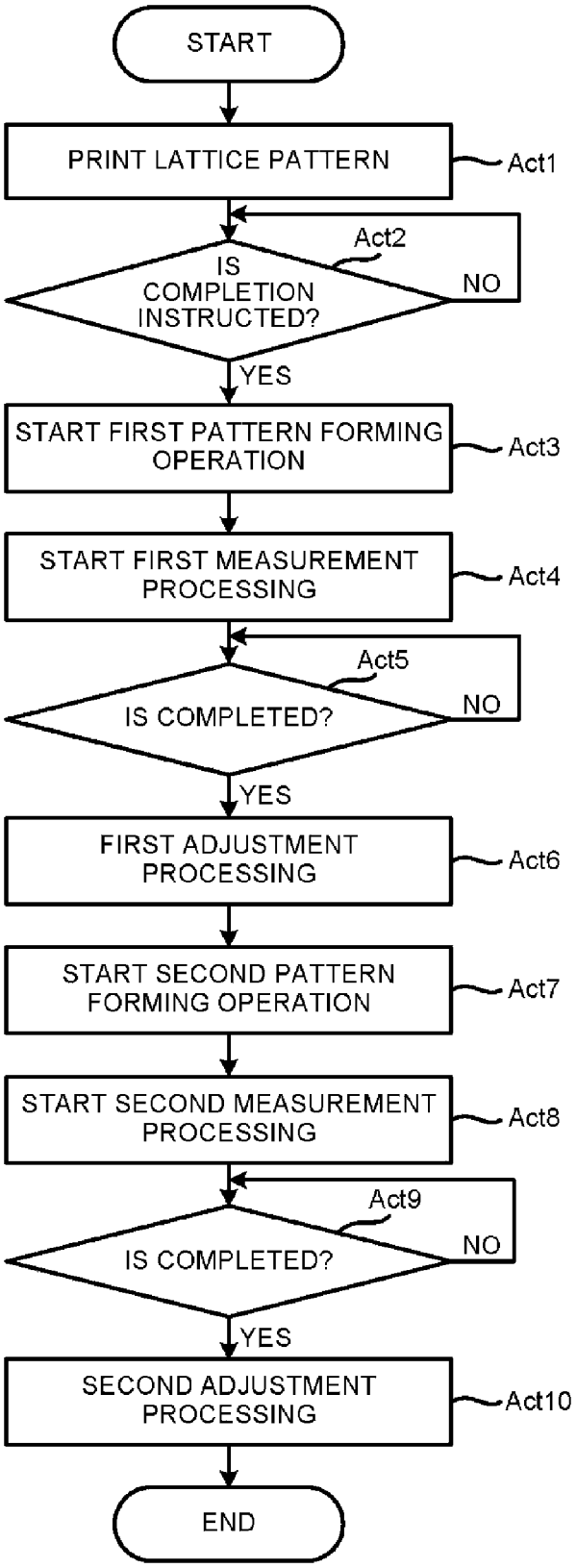
FIG. 3 is a flowchart illustrating a control processing of a CPU shown in FIG. 2.

FIG. 3 is a flowchart illustrating the control processing of the CPU 7*a*.

In ACT 1, the CPU 7*a* carries out the control processing for printing a lattice pattern.

The lattice pattern is a pattern for respectively measuring the first and the second starting positions and the first and the second magnifications for the element image of a reference color. The image data representing the lattice pattern is written in the ROM 7*b* or the auxiliary storage section 7*d* in advance. The reference color is determined to be any of the black, magenta, cyan and yellow color by, for example, the designer of the MFP 100. In the present embodiment, the image forming section for forming an element image of the reference color is set as a main forming section and the other image forming sections are set as sub-forming sections. In the present embodiment, black color is set as the reference color. Thus, the image forming section 24K is the main forming section and the image forming sections 24M, 24C and 24Y are sub-forming sections.

The CPU 7*a* enables each section of the printer 102 to carry out operations which are almost the same as general printing operations to print the lattice pattern on paper. However, the CPU 7*a* does not enable the other image forming sections 24M, 24C and 24Y in the image forming sections 24K, 24M, 24C and 24Y except the image forming section 24K corresponding to the reference color to carry out image forming processing.

Figure 4:
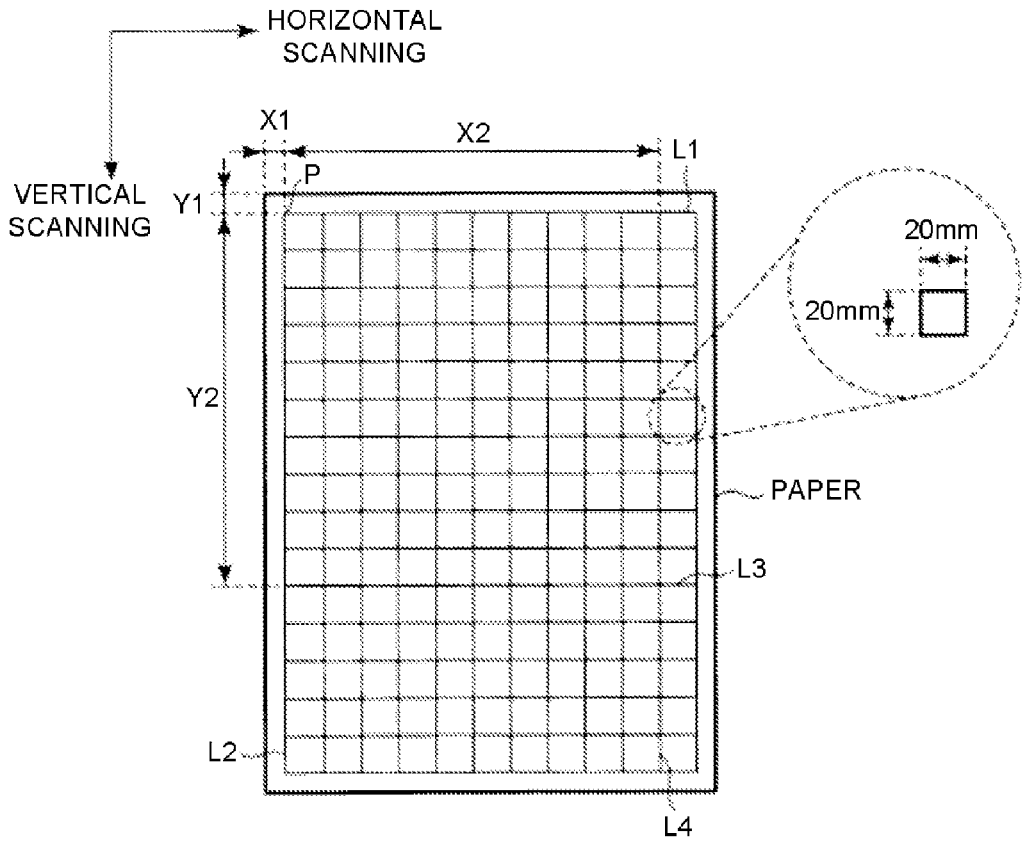
FIG. 4 is a diagram illustrating a printing example of a lattice pattern.

FIG. 4 is a diagram illustrating a printing example of the lattice pattern.

The lattice pattern is a pattern obtained by arranging straight lines in the horizontal scanning direction and straight lines in the vertical scanning direction in parallel at equal intervals. A plurality of straight lines contain the initial horizontal scanning line and the line including the concatenation of the first pixel (colored or not colored) of each horizontal scanning line. In a case where the printing of the lattice pattern is carried out exactly as the designed pixel density, the interval (hereinafter referred to as standard interval) between the straight lines is determined to be any value by, for example, the designer of the MFP 100. In the present embodiment, the standard interval is set to 20 mm. The width of the straight line, though preferred to be one pixel, may also be more than one pixel.

In the lattice pattern, the reference pixel is contained in an intersection P of the first straight line L1 in the horizontal scanning direction and the first straight line L2 in the vertical scanning direction. Thus, the operator respectively measures a distance X1 and a distance Y1 from the end part of the paper to the intersection P if the paper on which the lattice pattern is printed is discharged to the paper discharge tray 5. The distances X1 and Y1 are indexes representing the first and the second starting positions.

Further, the operator respectively measures a distance Y2 from the first straight line L1 in the horizontal scanning direction to the n-th straight line L3 in the horizontal scanning direction and a distance X2 from the first straight line L2 in the vertical scanning direction to the n-th straight line L4 in the vertical scanning direction. In addition, the value n can be any integer, and in FIG. 4, the value n is "11". The distances X2 and Y2 are indexes representing the first and the second magnifications.

Each of the four laser scanners of the exposure section 25 starts the exposure operation based on one line of data in the image data at the timing when the count value of an image clock started from the moment a HSYNC sensor detects the laser light reaches a first setting value. Thus, in a case where the distance X1 is different from a specification value serving as the first starting position, the operator adjusts the first setting value to minimize the difference. In addition, the specification value serving as the first starting position is properly determined by, for example, the designer of the MFP 100.

Each of the four laser scanners of the exposure section 25 realizes the horizontal scanning by scanning the laser light emitted by a fixed light emission device on the photoconductive drum through a rotating polygon mirror. Thus, if the speed of the light emission device to emit light corresponding to the image data is constant, the interval of the pixels in the horizontal scanning direction, that is, the first magnification, changes according to the rotation speed of the polygon mirror. Thus, in a case where distance X2 is different from a value calculated through a formula of [standard interval*(n−1)], the operator adjusts the rotation speed of the polygon mirror to minimize the difference. In addition, the polygon mirror is rotated by one of the motors contained in the motor group 6, thus, adjusting the rotation speed of the polygon mirror means adjusting the rotation speed of the motor.

Each of the four laser scanners of the exposure section 25 starts the exposure operation based on the data relating to the first line in the image data at the timing when the count value of the number of horizontal scanning lines from a given timing relating to the conveyance of paper reaches a second setting value. In addition, for example, the number of the horizontal scanning lines can be counted as the number of times the HSYNC sensor detects the laser light. Thus, if the conveyance speed of the paper and the rotation speed of the transfer belt 20 are constant, the position where the first line is printed on the paper changes according to the second setting value. Thus, in a case where the distance Y1 is different from a specification value serving as the second starting position, the operator adjusts the second setting value to minimize the difference. In addition, the specification value serving as the second starting position is properly determined by, for example, the designer of the MFP 100.

Each of the image forming sections 24K, 24M, 24C and 24Y forms an element image on the transfer belt 20 by transferring the image formed on the photoconductive drum to the transfer belt 20. Thus, if the rotation speed of the transfer belt 20 is constant, the intervals of the horizontal scanning lines in the element image change according to the rotation speed of the photoconductive drum. If the interval changes, the second magnification changes as well. Thus, in a case where distance Y3 is different from a value calculated through a formula of [standard interval*(n−1)], the operator adjusts the rotation speed of the photoconductive drum of the image forming section 24K to minimize the difference. The motor group 6 rotates the photoconductive drums of the image forming sections 24M, 24C and 24Y at a rotation speed which is the same peripheral speed as the image forming section 24K.

Through various adjustments described above, the formation position of the element image of black color serving as the reference color on the paper becomes the specified position.

Then the CPU 7*a* confirms whether or not the completion of the adjustment work described above is instructed in ACT 2. If it is determined that the completion is not instructed (NO in ACT 2), the CPU 7*a* repeats the processing in ACT 2. That is, the CPU 7*a* waits until the completion of the adjustment work is instructed in ACT 2. On the other hand, if the completion of the adjustment work is instructed through a given operation of the operator on the operation panel 104, the CPU 7*a* determines YES in ACT 2, and then ACT 3 is taken.

In ACT 3, the CPU 7*a* starts the control processing for starting a first pattern forming operation. The first pattern forming operation is an operation for forming the first pattern on different areas of the transfer belt 20 through each of the image forming sections 24K, 24M, 24C and 24Y. The first pattern forming operations may be a printing operation, or an operation that does not transfer the first pattern to the paper.

The first pattern includes a first straight line in the horizontal scanning direction that crosses the detection position of the sensor 26 and a second straight line that crosses the detection position of the sensor 26 and is inclined to a first angle against the first straight line.

Figure 5:
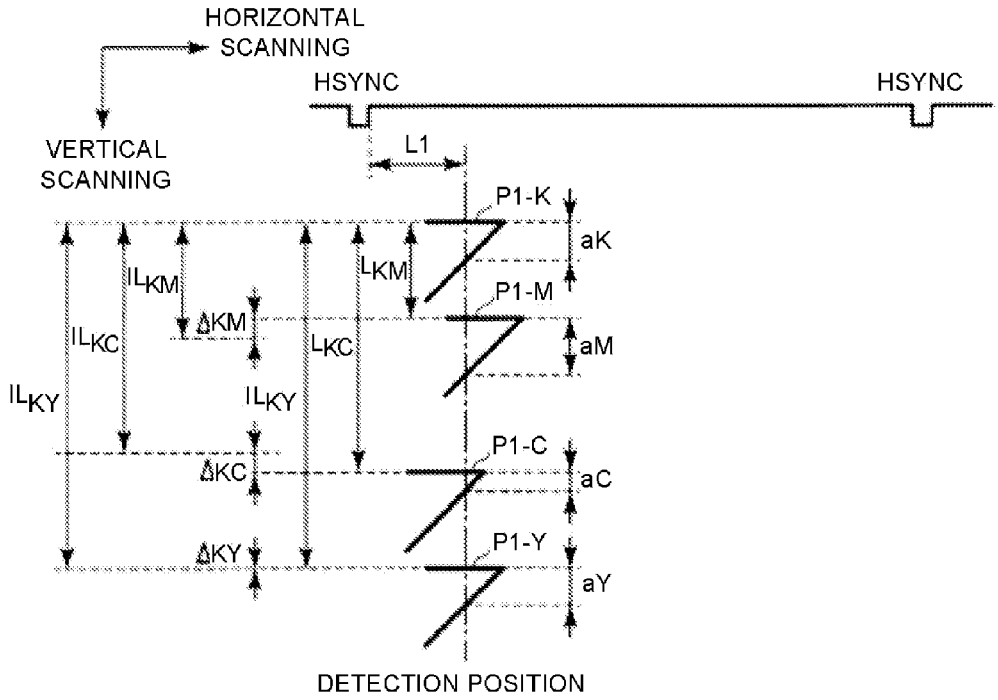
FIG. 5 is a diagram illustrating a formation example of a first pattern.

FIG. 5 is a diagram illustrating a formation example of the first pattern.

In the example shown in FIG. 5, the first patterns P1-K, P1-M, P1-C and P1-Y of each of the black, magenta, cyan and yellow colors are formed in parallel in the vertical scanning direction on the transfer belt 20.

In the first patterns P1-K, P1-M, P1-C and P1-Y, the straight line extending in the horizontal direction in FIG. 5 is the first straight line and the straight line extending in the oblique direction is the second straight line. In addition, it is also applicable that the first straight line and the second straight line are not connected with each other. Further, the inclination of the second straight line may be reversed.

The CPU 7*a* operates each of the image forming sections 24K, 24M, 24C and 24Y at the timing of forming the first patterns P1-K, P1-M, P1-C and P1-Y of each color on different areas, as shown in FIG. 5, using one image data representing the first pattern. However, the CPU 7*a* controls the operation timing of each of the image forming sections 24M, 24C and 24Y to minimize the difference between expected values ILkc, ILkm and ILky and the distances Lkc, Lkm and Lky from the first line in the first pattern P1-K to the first line of each of the first patterns P1-M, P1-C and P1-Y. The expected values ILkc, ILkm and ILky are the distances Lkc, Lkm and Lky in a case where the second starting position of each of the image forming sections 24M, 24C and 24Y is exactly the same as the specification value thereof.

In this way, if the first starting position of each of the image forming sections 24M, 24C and 24Y is the same as the first starting position of the image forming section 24K, the interval in any of the first patterns P1-M, P1-C and P1-Y between the first straight line and the second straight line at one position in the horizontal scanning direction is the same as that in the first pattern P1-K. Otherwise (that is, if the first starting position of each of the image forming sections 24M, 24C and 24Y is not the same as the first starting position of the image forming section 24K), difference occurs in the intervals mentioned above.

Further, if the second starting position of each of the image forming sections 24M, 24C and 24Y is exactly the same as the specification value thereof, the distances Lkc, Lkm and Lky is constant with the expected values ILkc, ILkm and ILky. However, if the second starting position of each of the image forming sections 24M, 24C and 24Y is shifted from the specification value thereof, the distances Lkc, Lkm and Lky differ from the expected values ILkc, ILkm and ILky.

The first patterns P1-K, P1-M, P1-C and P1-Y reach the detection position of the sensor 26 in sequence. Thus, the first straight line of the first pattern P1-K, the second straight line of the first pattern P1-K, the first straight line of the first pattern P1-M, the second straight line of the first pattern P1-M, the first straight line of the first pattern P1-C, the second straight line of the first pattern P1-C, the first straight line of the first pattern P1-Y and the second straight line of the first pattern P1-Y pass through the detection position in sequence. Then the sensor 26 detects these straight lines sequentially.

In ACT 4, the CPU 7*a* starts a first measurement processing. The first measurement processing is a processing for respectively measuring intervals aK, aM, aC and aY between the first line and the second line at the detection position in each of the first patterns P1-K, P1-M, P1-C and P1-Y, and the distances Lkc, Lkm and Lky based on the detection signal of the sensor 26. The CPU 7*a* executes the first measurement processing in parallel with the control processing started in ACT 3 as the processing of a separate task from the control processing.

Specifically, the CPU 7*a* measures the intervals aK, aM, aC and aY as the number of horizontal scanning lines during each of the periods between the first and the second line detection, the third and the fourth line detection, the fifth and the sixth line detection, and the seventh and the eighth line detection based on the sensor 26. Further, the CPU 7*a* measures the distances Lkc, Lkm and Lky as the number of horizontal scanning lines during periods from the moment the sensor 26 detects a line initially to the moment the sensor 26 detects the third, the fifth and the seventh lines.

If the formation of the first pattern P1-Y is completed, the CPU 7*a* ends the control processing started in ACT 3. Further, if the measurement of the interval aY is completed, the CPU 7*a* ends the first measurement processing started in ACT 4.

The CPU 7*a* confirms whether or not the first measurement processing is ended in ACT 5. Then, if it is determined NO as the first measurement processing is still being carried out, the CPU 7*a* repeats the processing in ACT 5. That is, the CPU 7*a* waits until the first measurement processing is ended in ACT 5. On the other hand, if the CPU 7*a* determines YES in ACT 5 as the first measurement processing is ended, ACT 6 is taken.

In ACT 6, the CPU 7*a* carries out the first adjustment processing.

In the first adjustment processing, the CPU 7*a* adjusts the first and the second starting positions in each of the image forming sections corresponding to colors other than the reference color to match the formation positions of the element images of colors other than the reference color with the formation position of the element image of the reference color.

Specifically, the CPU 7*a* adjusts the first setting values in the three laser scanners of the exposure section 25 for the magenta, the cyan and the yellow colors to minimize the differences between aK and each of aM, aC and aY.

Further, the CPU 7*a* adjusts the second setting values in the three laser scanners of the exposure section 25 for the magenta, the cyan and the yellow colors to minimize each of differences Δkc, Δkm and Δky between the expected values ILkc, ILkm and ILky and the distances Lkc, Lkm and Lky.

Figure 6:
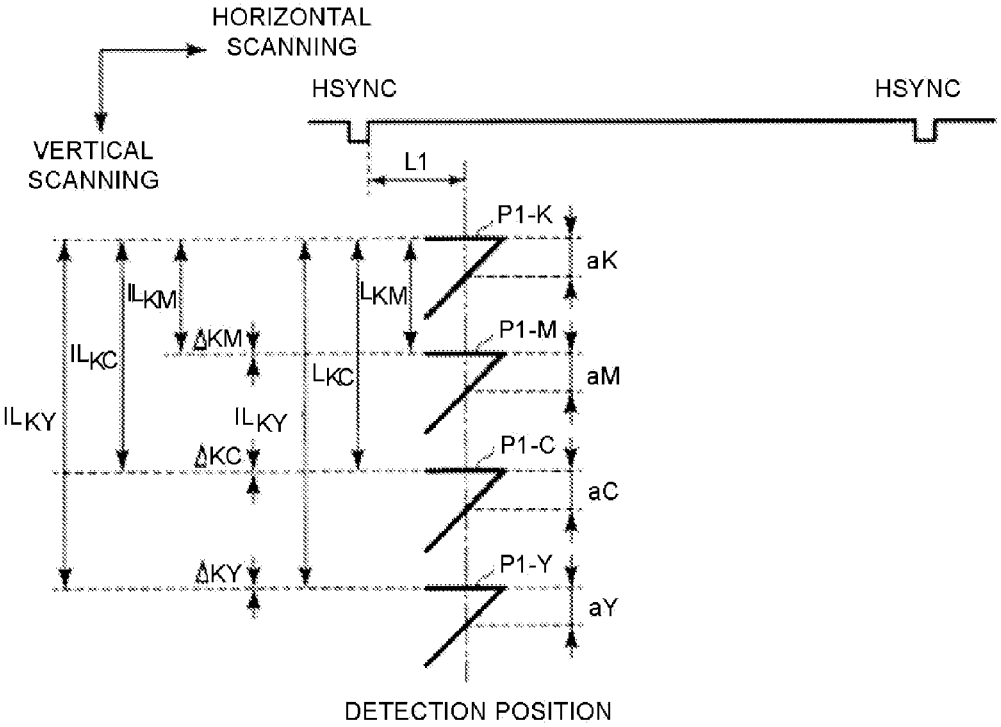
FIG. 6 is a diagram illustrating a formation example of the first pattern after a first adjustment processing is completed.

FIG. 6 is a diagram illustrating a formation example of the first pattern after the first adjustment processing is completed.

In accordance with the description above, in a state in which the adjustments of the first and the second setting values relating to all of the four colors are completed, the first patterns P1-K, P1-M, P1-C and P1-Y are formed as shown in FIG. 6.

Generally, the first patterns P1-K, P1-M, P1-C and P1-Y can be formed as shown in FIG. 6 after the CPU 7*a* carries out the processing in ACT 3-ACT 6 once. Thus, in the present embodiment, the CPU 7*a* carries out the processing in ACT 3-ACT 6 only once.

However, the CPU 7*a* may carry out the processing in ACT 3-ACT 6 repeatedly until it can be confirmed that the first patterns P1-K, P1-M, P1-C and P1-Y are formed as shown in FIG. 6. In this way, the precision of the position alignment of each color can be improved though a longer time is needed for the adjustment.

In ACT 7, the CPU 7*a* starts the control processing for starting a second pattern forming operation. The second pattern forming operation is an operation for forming the second pattern on different areas of the transfer belt 20 through each of the image forming sections 24K, 24M, 24C and 24Y. The second pattern forming operations may be a printing operation, or an operation that does not transfer the second pattern to the paper.

The second pattern includes a third straight line in the horizontal scanning direction that crosses the detection position of the sensor 26 and a fourth straight line that crosses the detection position of the sensor 26 and is inclined to a second angle against the third straight line. The second angle is larger than the first angle.

Figure 7:
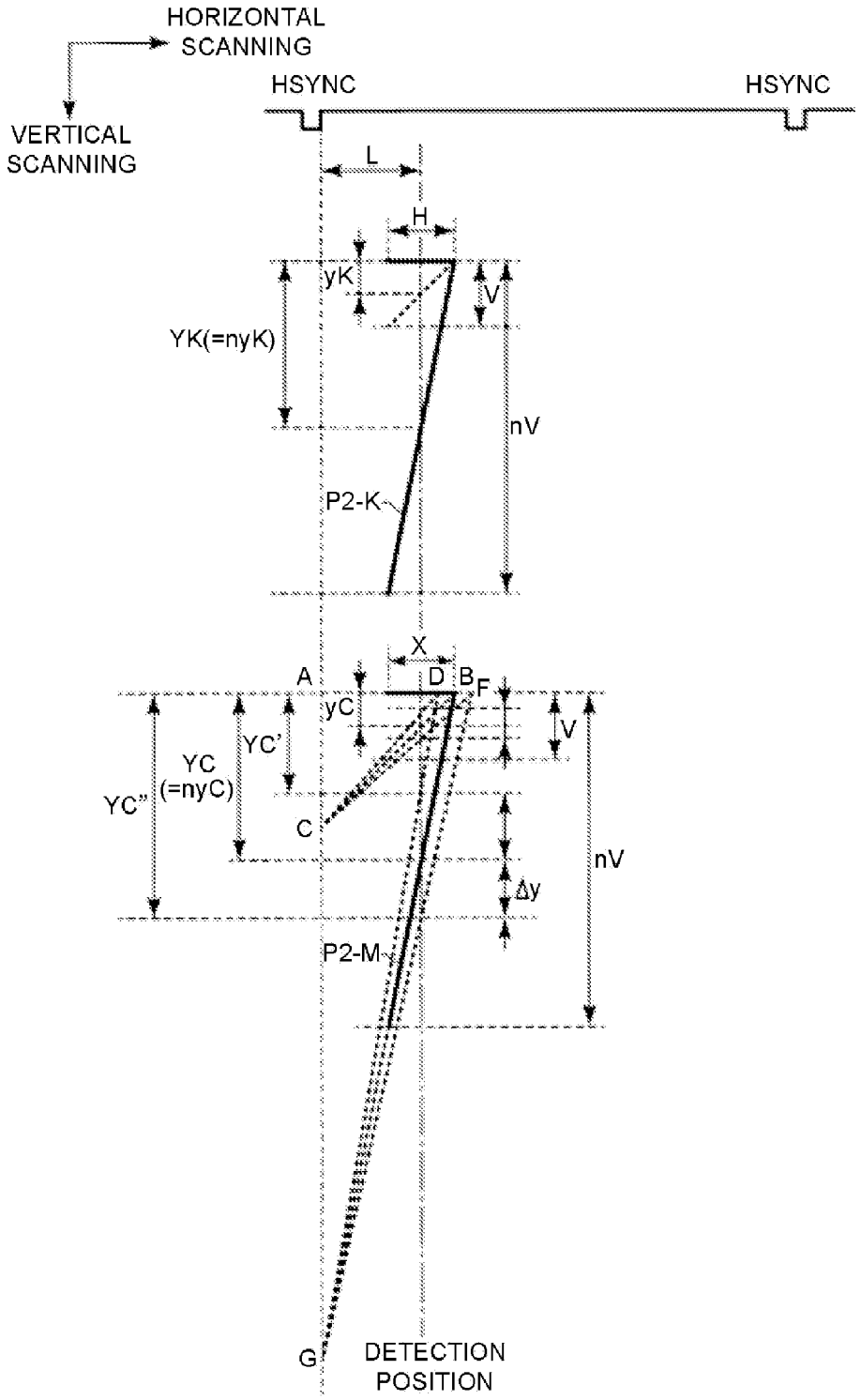
FIG. 7 is a diagram illustrating a formation example of a second pattern.

FIG. 7 is a diagram illustrating a formation example of the second pattern.

In the example shown in FIG. 7, though the second patterns P2-K, P2-M, P2-C and P2-Y of each of the black, magenta, cyan and yellow colors are formed in sequence on the transfer belt 20, only the patterns P2-K and P2-M are shown in FIG. 7.

In the second patterns P2-K and P2-M, the straight line extending in the horizontal direction in FIG. 7 is the third straight line and the straight line extending in the oblique direction is the fourth straight line. In addition, it is also applicable that the third straight line and the fourth straight line are not connected with each other. Further, the inclination of the fourth straight line may be reversed. In the example shown in FIG. 7, a pattern obtained by enlarging the first pattern only in the vertical scanning direction for n times is set as the second pattern. That is, the width of the second pattern in the vertical scanning direction is nV while the width of the first pattern in the vertical scanning direction is V.

The CPU 7*a* operates each of the image forming sections 24K, 24M, 24C and 24Y at the timing of forming the second patterns P2-K, P2-M, P2-C and P2-Y of each color on different areas, as shown in FIG. 7, using one image data representing the second pattern.

In this way, if the first magnification of each of the image forming sections 24M, 24C and 24Y is the same as the first magnification of the image forming section 24K, the interval in any of the second patterns P2-M, P2-C and P2-Y between the third straight line and the fourth straight line at one position in the horizontal scanning direction is the same as that in the second pattern P2-K. Otherwise (that is, if the first magnification of each of the image forming sections 24M, 24C and 24Y is not the same as the first magnification of the image forming section 24K), difference occurs in the intervals mentioned above.

The second patterns P2-K, P2-M, P2-C and P2-Y reach the detection position of the sensor 26 in sequence. Thus, the third straight line of the second pattern P2-K, the fourth straight line of the second pattern P2-K, the third straight line of the second pattern P2-M, the fourth straight line of the second pattern P2-M, the third straight line of the second pattern P2-C, the fourth straight line of the second pattern P2-C, the third straight line of the second pattern P2-Y and the fourth straight line of the second pattern P2-Y pass through the detection position in sequence. Then the sensor 26 detects these straight lines sequentially.

In ACT 8, the CPU 7*a* starts a second measurement processing. The second measurement processing is a processing for respectively measuring intervals YK, YM, YC and YY between the third line and the fourth line at the detection position in each of the second patterns P2-K, P2-M, P2-C and P2-Y based on the detection signal of the sensor 26. The CPU 7*a* executes the second measurement processing in parallel with the control processing started in ACT 7 as the processing of a separate task from the control processing.

Specifically, the CPU 7*a* measures the intervals YK, YM, YC and YY as the number of horizontal scanning lines during each of the periods between the first and the second line detection, the third and the fourth line detection, the fifth and the sixth line detection, and the seventh and the eighth line detection based on the sensor 26.

If the formation of the second pattern P2-Y is completed, the CPU 7*a* ends the control processing started in ACT 7. Further, if the measurement of the interval YY is completed, the CPU 7*a* ends the second measurement processing started in ACT 8.

The CPU 7*a* confirms whether or not the second measurement processing is ended in ACT 9. Then, if it is determined NO as the second measurement processing is still being carried out, the CPU 7*a* repeats the processing in ACT 9. That is, the CPU 7*a* waits until the second measurement processing is ended in ACT 9. On the other hand, if the CPU 7*a* determines YES in ACT 9 as the second measurement processing is ended, ACT 10 is taken.

In ACT 10, the CPU 7*a* carries out the second adjustment processing.

In the second adjustment processing, the CPU 7*a* adjusts the rotation speed of the polygon mirror in each of the laser scanners corresponding to colors other than the reference color in the four laser scanners of the exposure section 25 to match the first magnification of the element images of colors other than the reference color with the first magnification of the element image of the reference color.

Specifically, the CPU 7*a* adjusts the rotation speeds of the polygon mirrors in the three laser scanners of the exposure section 25 for the magenta, the cyan and the yellow colors to minimize the differences between YK and each of YM, YC and YY.

The adjustment of the first position is completed in the first adjustment processing. Further, the motor group 6 rotates the photoconductive drums in the image forming sections 24M, 24C and 24Y at the same rotation speed as the image forming section 24K, thus, the second magnification is almost equal. Thus, the second patterns P2-M, P2-C and P2-Y are compressed or expanded, according to the deviation of the first magnification, in the horizontal scanning direction with respect to the second pattern P2-K. That is, in a case where the first magnification of the image forming section 24K is the same with that of the image forming section 24M, the length H of the third straight line in the second pattern P2-K is consistent with the length X of the third straight line in the second pattern P2-M, as shown in FIG. 7.

When the length X of the third straight line in the second pattern P2-M is equal to the length H, the third and the fourth straight lines of the second pattern P2-M are along a straight line AB and a straight line BG in FIG. 7, respectively.

In this case, if the first magnification in the image forming section 24M is smaller than the first magnification in the image forming section 24K, and the length X of the third straight line in the second pattern P2-M is shorter than the length H, the intersection of the third straight line and the fourth straight line in the second pattern P2-M is a point D which is closer to the point A than the point B. Even in this case, the second magnification is constant, thus, the point G does not change. Thus, the third and the fourth straight lines in the second pattern P2-M are along a straight line AD and a straight line DG in FIG. 7, respectively. The angle formed by the third and the fourth straight lines in the second pattern P2-M is ∠ADG which is larger than an angle ∠ABG formed by the third and the fourth straight lines in the second pattern P2-M when the length X of the third straight line in the second pattern P2-M is equal to the length H.

On the contrary, if the first magnification in the image forming section 24M is larger than the first magnification in the image forming section 24K, and the length X of the third straight line in the second pattern P2-M is longer than the length H, the intersection of the third straight line and the fourth straight line in the second pattern P2-M is a point F which is further away from the point A than the point B. Even in this case, the second magnification is constant, thus, the point G does not change. Thus, the third and the fourth straight lines in the second pattern P2-M are along a straight line AF and a straight line FG in FIG. 7, respectively. The angle formed by the third and the fourth straight lines in the second pattern P2-M is ϕAFG which is smaller than an angle ∠ABG formed by the third and the fourth straight lines in the second pattern P2-M when the length X of the third straight line in the second pattern P2-M is equal to the length H.

As a result, the position where the fourth straight line in the second pattern P2-M crosses the detection position changes according to the first magnification.

By the way, though the first magnification in the first pattern P1-M is ignored, actually, the first pattern P1-M is affected by the first magnification as much as the second pattern P2-M is. However, the angle formed by the first and the second straight lines of the first pattern P1-M is smaller than the angle formed by the third and the fourth straight lines of the second pattern P2-M, and the point C equivalent to the point G is closer to the point A than the point G, therefore, the change rate of the position where the second straight line crosses the detection position according to the first magnification in the first pattern P1-M is smaller than the change rate of the position where the fourth straight line crosses the detection position according to the first magnification in the second pattern P2-M.

The description above is applicable for the cyan and the yellow colors as well.

In this way, the difference between the interval YK and each of the intervals YM, YC and YY, which represents the change of the first magnification significantly, is an index representing the difference in the first magnifications with high precision.

Thus, the first magnification relating to each of the magenta, the cyan and the yellow colors can be matched with the first magnification relating to the black color with high precision through the second adjustment processing.

In this way, in accordance with the MFP 100, the horizontal scanning direction magnification can be adjusted based on the detection result of one sensor 26.

The following various deformation implementations are also applicable.

Even if the formation position of the element image of the reference color on the paper is a little shifted from the specified position, the quality of the image is not degraded as long as the element images of other colors overlap with the element image of the reference color correctly. Thus, it is also applicable even if the implementation frequency of the adjustment based on the lattice pattern is less than that of the first and the second adjustments. Thus, through the control processing in which the processing in ACT 1 and ACT 2 is omitted, the adjustment based on the lattice pattern and the first and the second adjustments may be carried out at different timing.

Element images of the same color may be formed in part or all of a plurality of image forming sections. For example, black element images may be formed in both of two image forming sections. Specifically, it is assumed that in one image forming section, an element image is formed with black toner which can be erased through a given processing such as heating processing, and in the other image forming section, an element image is formed with general black toner which cannot be erased.

The description above is also applicable in a case where the number of the image forming sections is any value (other than four) that is equal to or larger than two. For example, it is applicable to arrange only two image forming sections which form element images with erasable and inerasable toner, respectively. In such a case where only two image forming sections are arranged, there is only one sub-forming section.

The element image may also be directly formed on the paper through the image forming sections 24K, 24M, 24C and 24Y. However, in this case, the sensor 26 is arranged to face the surface of the paper which passed through all the image forming sections 24K, 24M, 24C and 24Y.

In a case where one laser scanner motor in the exposure section 25 is shared by a plurality of colors, the frequency of the image transfer clock in the horizontal scanning direction of the image forming sections 24M, 24C and 24Y is adjusted to adjust the first magnification of the colors other than the reference color in the second adjustment processing in ACT 10.

While certain embodiments have been described, these embodiments have been presented by way of example only, and are not intended to limit the scope on the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a plurality of image forming sections, which are arranged in parallel in a vertical scanning direction intersecting a horizontal scanning direction in such a manner that the horizontal scanning directions thereof are parallel to each other, configured to form images with coloring agent at formation positions thereof on a medium moving in the vertical scanning direction; wherein the plurality of image forming sections can further change the magnifications of the formed images in the horizontal scanning direction, separately, and one of the plurality of image forming sections is pre-determined as a main forming section and one or a plurality of the other image forming sections is pre-determined as a sub-forming section;

a detection section configured to detect the existence of the coloring agent at one detection position in the horizontal scanning direction for a medium which passed through the formation position of each of the plurality of image forming sections;

a first control section configured to control the plurality of image forming sections to form first patterns including a first straight line in the horizontal scanning direction that crosses the detection position and a second straight line that crosses the detection position and is inclined to a first angle against the first straight line on different areas of the medium, respectively;

a first adjustment section configured to adjust an operating condition of the one or the plurality of sub-forming sections to minimize the deviation of the image formation positions of the one or the plurality of sub-forming sections with respect to the image formation position of the main forming section based on the detection timing of the detection section during a period when the plurality of first patterns formed by the plurality of image forming sections under the control of the first control section pass through the detection section;

a second control section configured to control the plurality of image forming sections to form second patterns including a third straight line in the horizontal scanning direction that crosses the detection position and a fourth straight line that crosses the detection position and is inclined to a second angle larger than the first angle against the third straight line on different areas of the medium, respectively; and a second adjustment section configured to adjust an operating condition of the one or the plurality of sub-forming sections to minimize the difference in the magnification between the main forming section and the one or the plurality of sub-forming sections based on the detection timing of the detection section during a period when the plurality of second patterns formed by the plurality of image forming sections under the control of the second control section pass through the detection section.

2. The image forming apparatus according to claim 1, wherein the first adjustment section including:

a first measurement section configured to measure, based on the detection timing of the coloring agent by the sensor, a plurality of first intervals serving as intervals between the first straight line and the second straight line at the detection position relating to each of the plurality of first patterns respectively formed on the medium by the plurality of image forming sections, one second interval serving as an interval between the first straight line in the first pattern formed by the main forming section and the first straight line in the first pattern formed by the one sub-forming section, or a plurality of second intervals serving as intervals between the first straight line in the first pattern formed by the main forming section and each of the first straight lines in the first pattern formed by the plurality of sub-forming sections; and a first changing section configured to change the operating condition of the sub-forming section to minimize the difference between the first interval in the first pattern formed by the main forming section measured by the first measurement section and the one or the plurality of first intervals in the first pattern formed by the one or the plurality of sub-forming sections measured by the first measurement section, and minimize the difference between the one or the plurality of second intervals measured by the first measurement section for the one or the plurality of sub-forming sections and one or a plurality of expected values pre-determined for the one or each of the plurality of second intervals.

3. The image forming apparatus according to claim 1, wherein the second adjustment section including:

a second measurement section configured to measure a plurality of third intervals serving as intervals between the third straight line and the fourth straight line at the detection position relating to each of the plurality of second patterns respectively formed on the medium by the plurality of image forming sections; and a second changing section configured to change the magnification for the one or the plurality of sub-forming sections to minimize the difference between the third interval measured by the second measurement section for the main forming section and the one or each of the plurality of third intervals measured by the second measurement section for the one or the plurality of sub-forming sections.

4. The image forming apparatus according to claim 1, further comprising:

a transfer section configured to transfer the image formed on the medium to a second medium other than the medium.

5. A control method of the image forming apparatus, including:

controlling a plurality of image forming sections to form first patterns including a first straight line in the horizontal scanning direction that crosses a detection position and a second straight line that crosses the detection position and is inclined to a first angle against the first straight line on different areas of the medium, respectively;

adjusting an operating condition of the one or the plurality of sub-forming sections to minimize the deviation of the image formation positions of the one or the plurality of sub-forming sections with respect to the image formation position of the main forming section based on the detection timing of the detection section during a period when the plurality of first patterns formed by the plurality of image forming sections pass through the detection section;

controlling the plurality of image forming sections to form second patterns including a third straight line in the horizontal scanning direction that crosses the detection position and a fourth straight line that crosses the detection position and is inclined to a second angle larger than the first angle against the third straight line on different areas of the medium, respectively; and adjusting an operating condition of the one or the plurality of sub-forming sections to minimize the difference in the magnification between the main forming section and the one or the plurality of sub-forming sections based on the detection timing of the detection section during a period when the plurality of second patterns formed by the plurality of image forming sections pass through the detection section.

6. The control method according to claim 5, wherein in the adjustment of the operating condition of the one or the plurality of sub-forming sections for minimizing the deviation of the image formation positions, a plurality of first intervals serving as intervals between the first straight line and the second straight line at the detection position relating to each of the plurality of first patterns respectively formed on the medium by the plurality of image forming sections, one second interval serving as an interval between the first straight line in the first pattern formed by the main forming section and the first straight line in the first pattern formed by the one sub-forming section, or a plurality of second intervals serving as intervals between the first straight line in the first pattern formed by the main forming section and each of the first straight lines in the first pattern formed by the plurality of sub-forming sections are measured based on the detection timing of the coloring agent by the sensor; and the operating condition of the one or the plurality of sub-forming sections is changed to minimize the difference between the measured first interval in the first pattern formed by the main forming section and the measured one or plurality of first intervals in the one or the plurality of first patterns formed by the one or the plurality of sub-forming sections, and minimize the difference between the measured one or plurality of second intervals for the one or the plurality of sub-forming sections and one or a plurality of expected values pre-determined for the one or each of the plurality of second intervals.

7. The control method according to claim 5, wherein in the adjustment of the operating condition of the one or the plurality of sub-forming sections for minimizing the difference of the magnifications, a plurality of third intervals serving as intervals between the third straight line and the fourth straight line at the detection position relating to each of the plurality of second patterns respectively formed on the medium by the plurality of image forming sections are measured; and the magnification for the one or the plurality of sub-forming sections is changed to minimize the difference between the measured third interval for the main forming section and the one or each of the plurality of third intervals measured for the one or the plurality of sub-forming sections.

* * * * *